United States Patent [19]

Kitta et al.

[11] 4,247,848

[45] Jan. 27, 1981

[54] FIRE DETECTOR WITH A MONITOR CIRCUIT

[75] Inventors: Hiroyuki Kitta, Yamato; Yukio Yamauchi, Kawasaki, both of Japan

[73] Assignee: C. Hochiki Corporation, Tokyo, Japan

[21] Appl. No.: 9,446

[22] Filed: Feb. 5, 1979

[30] Foreign Application Priority Data

Feb. 16, 1978 [JP] Japan ..... 53-17701[U]

[51] Int. Cl.[3] ..... G08B 17/00; G08B 29/00

[52] U.S. Cl. ..... 340/584; 340/512; 340/587; 340/635

[58] Field of Search ..... 340/507, 587, 584, 512, 340/628, 595, 635

[56] References Cited

U.S. PATENT DOCUMENTS

| | | | |
|---|---|---|---|
| 3,492,589 | 1/1970 | Rotier | 340/507 |
| 3,787,838 | 1/1974 | Feintuch et al. | 340/635 |
| 4,151,522 | 4/1979 | Yamauchi | 340/587 |

*Primary Examiner*—Glen R. Swann, III
*Attorney, Agent, or Firm*—Phillips, Moore, Weissenberger, Lempio & Majestic

[57] ABSTRACT

In response to oscillator output pulses, a sample pulse generator supplies sample pulses to a fire sensor. In response to the sample pulses, the fire sensor produces a fire sensor signal. A judging circuit receives the fire sensor signals and, if they exceed a predetermined level, produces a judging pulse having a longer pulse duration than the oscillator pulses. This judging pulse is used to trigger an alarm signal. A monitor circuit consists of an AND gate and an OR gate. The AND gate receives as inputs the oscillator pulses and the judging pulses. The OR gate receives as inputs the output of the AND gate and the sample pulses. The output of the OR gate constitutes a monitor pulse that allows the simultaneous monitoring of three conditions, as follows:

(1) Lack of a monitor pulse indicates equipment failure.

(2) A monitor pulse with the same waveform as the sample pulse indicates normal operation (i.e., the oscillator and sample pulse generator are working but no judging pulse is being produced—no fire is detected).

(3) A monitor pulse with the same waveform as the oscillator output pulses indicates a fire has been detected (i.e., a judging pulse is present and the oscillator is functioning).

9 Claims, 15 Drawing Figures

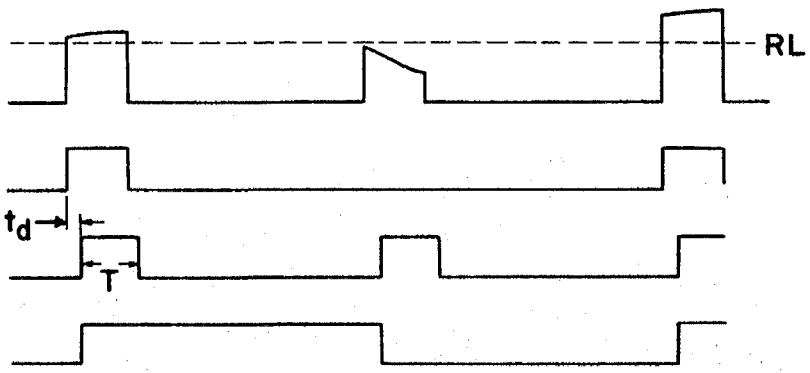
FIG.4A. P3
FIG.4B. P41a
FIG.4C. P41c
FIG.4D. P41b
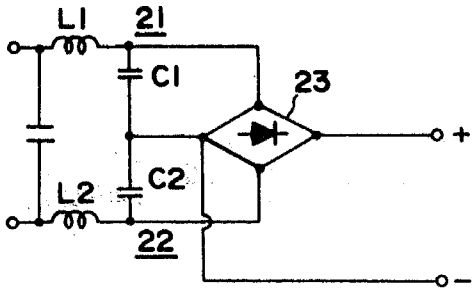
FIG.5.

FIRE DETECTOR WITH A MONITOR CIRCUIT

BACKGROUND OF THE INVENTION

The present invention relates to a fire detector having an oscillating circuit, a sampling pulse generating circuit for generating a sampling pulse on the basis of an oscillating output pulse of the oscillating circuit, a sensing circuit for producing a fire sensing signal at least at the time that the sampling pulse is transmitted, a judging circuit for producing a judging signal when the signal from the sensing circuit exceeds a predetermined level, and a fire alarm trigger signal transmitting circuit for generating a fire alarm trigger signal on the basis of the judging signal from the judging circuit and for transmitting the fire alarm trigger signal through a signal line to a fire alarm controller.

In order to monitor or check the operation of a fire detector, i.e., to check as to whether or not the fire detector is operating normally, the operational condition of the oscillator and the sensor have hitherto been checked individually. This leads to the drawback of low work efficiency with respect to the monitoring operation. In the case of a fire detector with a fire alarm trigger signal transmitting circuit of the so-called storage type which transmits an alarm trigger signal after the sensor has sensed smoke or heat or fire for more than a predetermined time period, for example, 20 seconds, the monitoring of the sensor cannot be completed until the lapse of the predetermined period after the smoke or heat has been sensed.

SUMMARY OF THE INVENTION

It is, therefore, a primary object of the invention to provide a fire detector with a monitor circuit which removes the above-mentioned disadvantages to monitor three conditions of the oscillator and the smoke or heat sensor by way of a single monitor terminal incorporated in the fire detector.

It is a secondary object of the invention to provide a fire detector with a monitor circuit which can preferably be employed with a fire detector having a storage type fire alarm trigger signal transmitting circuit and which monitors the existence of a fire sensing signal prior to the lapse of the above-mentioned predetermined time period and also monitors whether or not the fire detector.

One feature of a fire detector according to this invention is a pulse circuit means included in the judging circuit for producing a judging output signal pulse with a longer pulse duration than that of the oscillating output pulse from the oscillating circuit when the sensing signal exceeds the predetermined lever. The fire detector according to the invention also has a monitor circuit which receives the oscillating output pulse, the sampling pulse and the judging output signal, and which produces no output signal when no output is produced from the oscillating circuit, produces a signal with the same waveform as that of the sampling pulse when the sensor does not sense smoke or heat but the oscillating circuit is generating an output pulse, and produces a signal with the same waveform as that of the oscillating output pulse when the sensor senses smoke or heat under a condition that the oscillating circuit generates the oscillating output pulse.

In a preferred embodiment of a fire detector with a monitor circuit according to the present invention, the monitor circuit is comprised of an AND gate supplied with the output pulse from the oscillating circuit and the output pulse from the judging circuit, an OR gate supplied with the output signal from the AND gate and the sampling pulse from the sampling pulse generating circuit, and output means for deriving the output signal from the OR circuit as a monitor output signal.

Other objects and features of the invention will be apparent from the following description with reference to the accompanying drawings, in which:

BRIEF DESCRIPTION OF THE DRAWINGS

FIGS. 4A to 4D illustrate pulse waveforms at the respective portions in the circuit shown in FIG. 3; and FIG. 5 is an embodiment showing a circuit diagram of a power source circuit used in a fire detector according to the invention.

DESCRIPTION OF PREFERRED EMBODIMENTS

Figure 1:
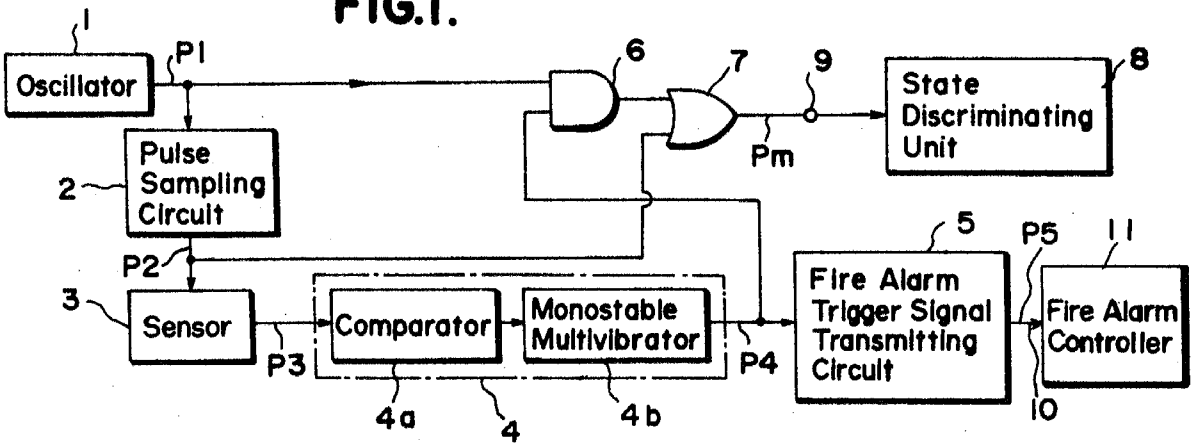
FIG. 1 is a block diagram showing an embodiment of a fire detector with a monitor circuit according to the invention.

Reference is made to FIG. 1 illustrating an embodiment of a fire detector with a monitor circuit according to the invention. As oscillation circuit 1 included in the fire detector according to the invention produces a pulse oscillating output signal P1 with a fixed frequency. A sampling pulse generating circuit 2, upon the receipt of the oscillating output signal P1 from the oscillator 1, produces sampling pulses P2 having a given frequency in relation to the oscillating output P1. A smoke or heat sensor 3 receives the sampling pulses P2 and produces a fire sensing signal P3 is synchronism with the sampling pulses P2. A judging circuit 4 produces judging pulses P4 with a wider pulse width than that of the oscillating output pulses P1 from the oscillating circuit 1, when the fire sensing signal P3 obtained from the sensor 3 exceeds a predetermined level. A fire alarm trigger signal transmitting circuit 5 produces a fire alarm trigger signal P5 in response to the signal P4 from the judging circuit 4. The pulse signal P1 from the oscillator 1 and the pulse signal P4 from the judging circuit 4 are supplied to an AND gate 6, the output of which is fed to OR gate 7. The sampling pulses $P_2$ are also applied to the OR gate 7. A state discriminating unit 8 such as a pulse width discriminating circuit is connected to output means such as a monitor output terminal 9 connected to the OR gate 7 when it is required to monitor the operational condition of the fire detector and is disconnected from the terminal 9 after the completion of the monitoring. The state discriminating unit 8 receives the output signal from the OR gate 7 via the monitor output terminal 9 for discriminating the pulse width of the output signal of the OR gate 7. As the state discriminating unit 8, use may be made of various external monitoring units which are connectable to the monitor output terminal 9, other than the pulse width discriminating circuit, waveform observing apparatus, for example, a synchroscope, or a monitor lamp to visualize difference between pulse durations (for example, the pulse width 1 msec of a pulse Pm2 and the pulse width 1 sec of the pulse Pm3), or the like. Further, the output means may be formed by a photo coupler instead of the output terminal 9. The alarm trigger signal P5 from the alarm trigger signal transmitting circuit 5 is transmitted through a signal line 10 to a fire alarm controller 11 in a conventional manner.

The sensor 3 may be of any conventional type, for example, a smoke sensor such as an ionizing type or a photoelectric type, a gas sensor, a heat sensor or the like. The judging circuit 4 may be a cascade connection circuit of a comparator (or a Schmitt trigger circuit) 4*a* and a monostable multivibrator 4*b*.

Figures 2A, 2B, 2C, 2D, 2E, 2F, 2G, 2H:
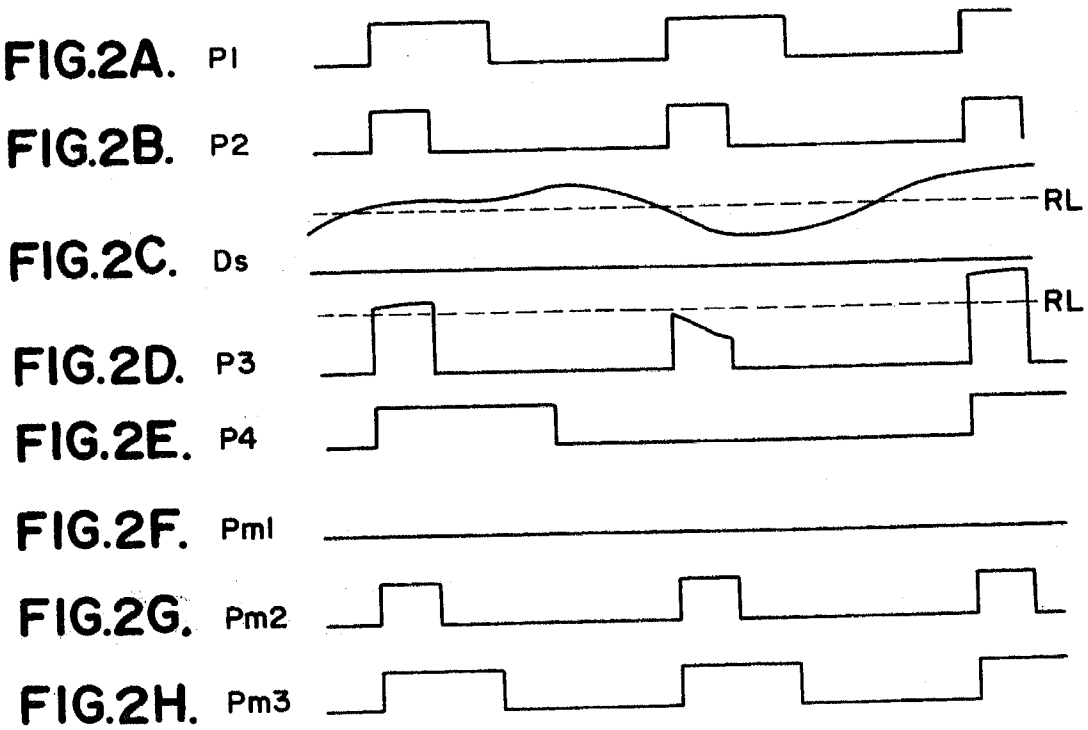
FIGS. 2A to 2H illustrate a set of waveforms at the respective portions in the circuit shown in FIG. 1.

The fire detector bus constructed according to the invention produces pulse waves shown in FIGS. 2A to 2H. As shown, the pulse P1 (FIG. 2A) with a fixed period generated from the oscillator 1 is applied to the sampling pulse generating circuit 2 to form the sampling pulse P2 (FIG. 2B) with a predetermined pulse width. The sampling pulse P2 is then applied to the sensor 3. Thus, the sensor 3 is operable only when it receives the sampling pulse P2. At the operable state of the sensor 3, if it senses smoke, gas, heat or the like, it produces an output signal. This intermittent sampling method of obtaining such as abnormal state sensing signal is a common practice to save power consumption in this field. When, for example, the density Ds of smoke and the reference density RL of smoke are as shown in FIGS. 2C and 2D, the output signal P3 of the smoke sensor 3 becomes as shown in FIG. 2D. The signal P3 is then compared with the reference level RL in the judging circuit 4. The pulse exceeding the reference level RL is shaped into the judging pulse P4 with a fixed pulse width P4, as shown in FIG. 2E, and this judging pulse P4 is supplied to the fire alarm trigger signal transmitting circuit 5, in which the judging signal P4 is properly processed in a conventional manner to produce the fire alarm trigger signal P5 which is applied to the fire alarm controller 11.

When the oscillator 1 fails to operate, the input signals to the AND gate 6 and the OR gate 7 are both logical "0" so that the monitor output Pm from the OR gate 7 is logical "0", as shown by the waveform Pm1 in FIG. 2F. The level of the signal Pm1 is observed by the state discriminator 8. When the smoke sensor 3 fails or operates normally under no smoke condition, and therefore, the sensor 3 does not sense smoke or the like, the output signal P4 from the judging circuit 4 becomes zero, so that the output signal from the AND gate 6 becomes "0". Therefore, the monitor output signal Pm derived from the OR gate 7 becomes the pulse Pm2, which is identical with the sampling pulse P2, as shown in FIG. 2G. In the case where both the oscillating circuit 1 and the sensor 2 operate normally and smoke or heat is sensed, the output signal P1 of the oscillating circuit 1 and the output signal P4 of the judging circuit 4 fully condition the AND gate 6 to gate the output signal P1 of the oscillating circuit 1. Then, the OR gate 7 receives the output signal P1 of the oscillator 1 and the sampling pulse P2. Accordingly, the monitor output signal Pm from the OR gate 7 is a pulse Pm3 which is identical with the output signal P1 of the oscillating circuit 1.

In the present invention, the output pulses Pm1, Pm2 and Pm3 are discriminated by applying the monitor output signal derived from the single output terminal 9 to the state discriminator 8. In other words, observed through the single terminal 9 are three states of the fire detector; an inoperative state of the oscillator 1, a state of the sensor 3 sensing no smoke or heat and a state where both the oscillator 1 and the sensor 3 are operating in normal states.

Figure 3:
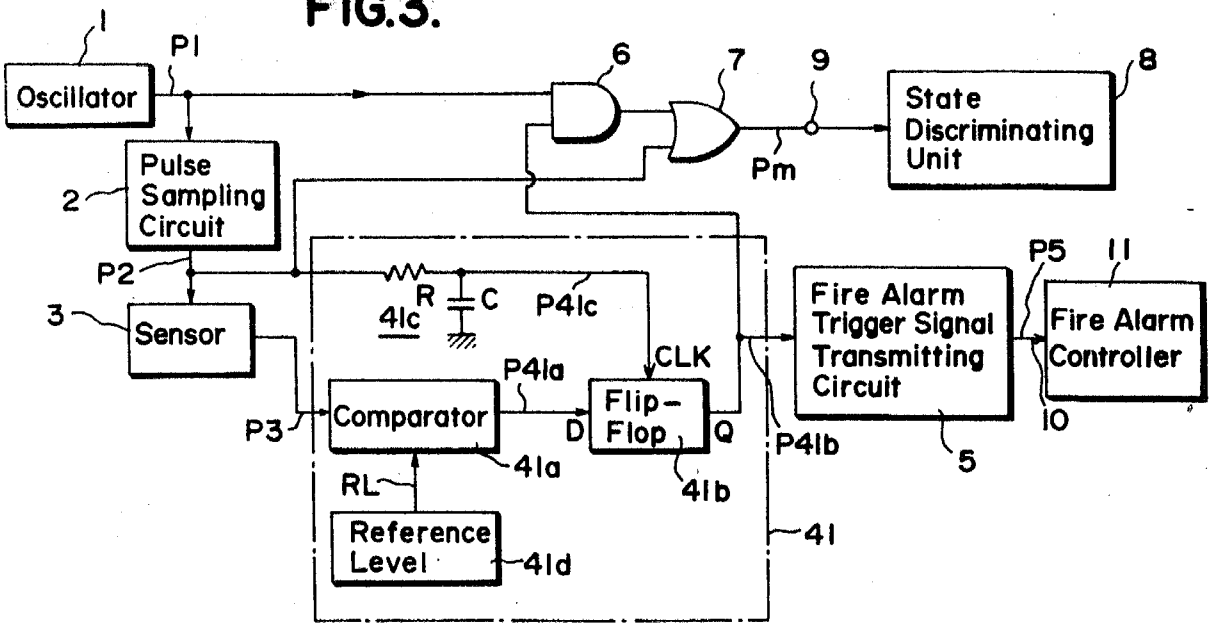
FIG. 3 is a block diagram showing another embodiment of a fire detector with a monitor circuit according to the invention.

A second embodiment of a fire detector according to the invention will be described with reference to FIG. 3. The basic construction of the second embodiment is substantially the same as that shown in FIG. 1, except for the judging circuit. Thus, the description to follow will be made placing an emphasis on the judging circuit which is designated by reference numeral 41 in this embodiment. As shown in FIG. 3, the judging circuit 41 has a comparator 41*a*, a D-type flip-flop 41*b* and an integrator as a delay circuit 41*c* including a resistor R and a capacitor C. The comparator 41*a* compares the output signal P3 from the sensor 3 with the reference level RL of a reference level generator 41*d* and produces an output signal P41*a* when the output signal P3 is larger than the reference level RL. In the D-type flip-flop circuit 41*b*, the output signal P41*a* from the comparing circuit 41*a* is applied to a D terminal of the flip-flop 41*b* and the sampling pulse P2 is supplied to a clock terminal CLK, through the delay circuit 41C. As shown in FIG. 4A, the output signal P3 from the sensor 3 is compared in level with the reference level RL by the comparator 41*a*, the output of which is the pulse P41*a* shown in FIG. 4B. This pulse P41*a* is applied to the D input of the D-type flip-flop circuit 41*b*. The sampling pulse P2 passes through the delay circuit 41*c* to the clock terminal CLK. Accordingly, it reaches the terminal CLK, with a delay of time $t_d$-determined by the time constant RC. The waveform of the delayed sampling pulse P41*c* is as shown in FIG. 4C. Accordingly, the pulse P41*b* having a pulse width T (T = period of the oscillating pulse P1 − time delay $t_d$) appears at the output terminal Q of the flip-flop circuit 41*b* with the time delay $t_d$ behind the pulse P41*a*. Further, in this embodiment, the pulses P1 and P2 are the same as those shown in FIGS. 2A and 2B.

As seen from the foregoing description, it will be clear that, when the oscillating circuit 1 does not operate in a normal condition, the monitor output Pm from the OR gate 7 has a waveform similar to that of the signal Pm1 shown in FIG. 2F. In the event that the sensor 3 has some failure and no sensing is made of smoke, gas or heat of fire, it produces an output signal with the waveform similar to the waveform Pm2 shown in FIG. 2G. In the event that both the oscillating circuit 1 and the sensor 3 operate in a normal condition and fire is sensed, the monitor output signal has a waveform similar to the waveform Pm3 shown in FIG. 2H.

According to this invention, as seen from the foregoing description, the mere connection of the state discriminating unit to a single monitor output terminal is sufficient to monitor three operating states of the fire detector and thereby these three states can be discriminated. The circuit construction of the monitor circuit in this invention is relatively simple. In these respects, the fire detector according to the invention is very useful in practical use. In addition, if the present invention is applied to a storage type fire detector, the monitoring of the above-mentioned three states is completed within a predetermined time period of the storage type alarm trigger signal transmitting circuit.

One of the preferable power sources for the fire detector with the monitor circuit according to this invention is shown in FIG. 5. In the circuit shown in FIG. 5, a DC input is filtered out through a filter 21 including an inductance L1 and a capacitor C1 and another filter 22 including an inductance L2 and a capacitor C2, for the purpose of noise elimination. Then, the filtered DC voltage is applied to a rectifier circuit 23 to form a power source supplying a DC output, the polarity of which is fixed regardless of the polarity of the DC input. Preferably, the terminals of the capacitors C1 and C2, which are not connected to the inductances L1 and L2, are not connected to ground but are connected commonly to the negative electrode side of the rectifier circuit 23. The fire detector shown in FIG. 1 or 3 with such a power source is free from noise problems and erroneous operation, thus ensuring good fire detecting operation and reliable monitoring operation.

While in the above mentioned embodiments of this invention the sensor 3 is explained as a smoke sensing device, the type of the sensor 3 is not limited to the smoke sensor and various kinds of sensors of a heat sensing type, a gas sensing type or the like may be preferably utilized as the sensor 3.

The invention has been described in detail with respect to preferred embodiments, and it will now be apparent from the foregoing to those skilled in the art that changes and modifications may be made without departing from the invention in its broader aspects. Therefore, the appended claims are intended to encompass all such changes and modifications as fall within the true spirit of the invention.

What is claimed is:

1. A fire detector having an oscillator circuit for generating an oscillator circuit output pulse, a sampling pulse generating circuit for generating a sampling pulse in response to said oscillator circuit output pulse, a fire sensor circuit for producing a fire sensing signal in response to said sampling pulse, a judging circuit for producing a judging pulse in response to said fire sensing signal's exceeding a predetermined level, said judging pulse having a longer pulse duration than said oscillator circuit output pulse, a fire alarm trigger signal transmitting circuit for generating a fire alarm trigger signal in response to said judging pulse, a fire alarm controller circuit for generating an alarm signal in response to said fire alarm trigger signal, and a monitor circuit, having an output terminal and being responsive to said oscillator circuit output pulse, said sampling pulse and said judging pulse, for producing at said output terminal no monitor output pulse in response to the absence of said oscillator circuit output pulse, for producing at said output terminal a monitor output pulse having the same waveform as said sampling pulse in response to the absence of said judging pulse and the presence of said oscillator circuit output pulse, and for producing at said output terminal a monitor output pulse having the same waveform as said oscillator circuit output pulse in response to the presence of both said oscillator circuit output pulse and said judging pulse.

2. A fire detector according to claim 1 wherein said monitor circuit comprises an AND gate having a first input receiving said oscillator circuit output pulse, a second input receiving said judging pulse, and an output, and an OR gate having a first input connected to said output of said AND gate, a second input receiving said sampling pulse, and an output for producing said monitor output pulse.

3. A fire detector according to claim 2 wherein said judging circuit comprises a comparator for comparing said fire sensing signal to said predetermined level and having an output, and a monostable multivibrator connected to said output of said comparator, said comparator and said monostable multivibrator being connected in cascade.

4. A fire detector according to claim 2 wherein said judging circuit comprises a Schmitt trigger circuit having an input receiving said fire sensing signal and an output, and a monostable multivibrator connected to said output, said Schmitt trigger circuit and said monostable multivibrator being connected in cascade.

5. A fire detector according to claim 2 wherein said judging circuit comprises a comparator for comparing said fire sensing signal to said predetermined level to produce a comparator output signal, a delay circuit for delaying said sampling pulse to produce a delayed sampling pulse, a D-type flip-flop circuit having a D terminal receiving said comparator output signal and a clock terminal receiving said delayed sampling pulse to produce a flip-flop circuit output pulse being said judging pulse.

6. A fire detector according to claim 5 wherein said delay circuit comprises an integrating circuit having a resistor and a capacitor.

7. A fire detector according to claim 2 further comprising a pulse width discriminating circuit for discriminating the pulse width of said monitor output pulse.

8. A fire detector according to claim 2 further comprising waveform observing apparatus for displaying said monitor output pulse.

9. A fire detector according to claim 2 further comprising a monitor lamp for indicating said monitor output pulse.

* * * * *